US008113502B2

(12) United States Patent
Kozaki et al.

(10) Patent No.: US 8,113,502 B2
(45) Date of Patent: Feb. 14, 2012

(54) SHEET FEEDING DEVICE AND IMAGE FORMING APPARATUS

(75) Inventors: Daisuke Kozaki, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 789 days.

(21) Appl. No.: 11/677,908

(22) Filed: Feb. 22, 2007

(65) Prior Publication Data

US 2007/0267804 A1 Nov. 22, 2007

(30) Foreign Application Priority Data

Feb. 22, 2006 (JP) ..... 2006-044874

(51) Int. Cl.
*B65H 3/06* (2006.01)

(52) U.S. Cl. ..... 271/117

(58) Field of Classification Search ..... 271/114, 271/115, 117, 118
See application file for complete search history.

(56) References Cited

U.S. PATENT DOCUMENTS

| | | | | |
|---|---|---|---|---|
| 2,745,199 | A * | 5/1956 | Kreinberg | 40/518 |
| 4,842,425 | A * | 6/1989 | Betterton et al. | 384/440 |
| 5,265,859 | A * | 11/1993 | Watson et al. | 271/109 |
| 6,382,619 | B1 * | 5/2002 | Gustafson et al. | 271/117 |
| 7,370,857 | B2 | 5/2008 | Otsuki | |
| 2005/0001371 | A1 * | 1/2005 | Otsuki | 271/113 |
| 2005/0194732 | A1 | 9/2005 | Asada | |
| 2005/0242485 | A1 | 11/2005 | Shiohara et al. | |
| 2006/0071399 | A1 * | 4/2006 | Asada et al. | 271/117 |

FOREIGN PATENT DOCUMENTS

| | | | |
|---|---|---|---|
| JP | 2-271146 | * | 11/1990 |
| JP | 3-103614 | * | 4/1991 |
| JP | H05-090006 U | | 12/1993 |
| JP | 7-293551 | * | 11/1995 |
| JP | H09-196152 A | | 7/1997 |
| JP | 2002-211767 A | | 7/2002 |
| JP | 2004-331281 A | | 11/2004 |
| JP | 2005247521 A | | 9/2005 |
| JP | 2005314067 A | | 11/2005 |

OTHER PUBLICATIONS

Japanese Patent Office, Office Action for Japanese Patent Application No. 2006-044874, mailed Dec. 10, 2008.

* cited by examiner

*Primary Examiner* — Stefanos Karmis
*Assistant Examiner* — Thomas Morrison
(74) *Attorney, Agent, or Firm* — Baker Botts L.L.P.

(57) ABSTRACT

A sheet feeding device includes: an arm member that is provided with a drive shaft at a base end thereof, the arm member being configured to swingably rotate around the drive shaft; a feed roller that is disposed at a leading end of the arm member, the feed roller feeding a sheet by being rotated while pressed on the uppermost sheet; and a transmission mechanism that is provided with one or more transmission rollers that transmit power provided from the drive shaft to the feed roller. Each of the transmission rollers is provided with a spindle that protrudes from both side faces thereof along an rotational axis. The arm member is provided with one or more pairs of bearing members for the respective transmission rollers, each of the pairs of the bearing members being faced with each other and being monolithically formed on the arm member.

16 Claims, 12 Drawing Sheets

SHEET FEEDING DEVICE AND IMAGE FORMING APPARATUS

CROSS-REFERENCE TO RELATED APPLICATION

This application claims priority from Japanese Patent Application No. 2006-044874, filed on Feb. 22, 2006, the entire subject matter of which is incorporated herein by reference.

TECHNICAL FIELD

Aspects of the present invention relate to a sheet feeding device that feeds sheets such as cut sheets of a sheet of paper or a synthetic resin sheet (hereinafter, simply referred to as a sheet) one by one, and to an image forming apparatus provided with the sheet feeding device.

BACKGROUND

Conventionally, there is known a sheet feeding device provided with a feed roller that feeds a sheet to an image forming section of an image forming apparatus, such as an inkjet printer, the feed roller being disposed at a leading end portion of an arm having a base end portion that is rotatably supported by a body of the image forming apparatus.

In the sheet feeding device thus configured, the feed roller is pressed, by an urging force of a spring that presses the arm, on an uppermost sheet of a plurality of sheets that are stacked and accommodated in a sheet feed section that is configured by a sheet feeding cassette whose upper surface is opened.

The feed roller is driven to be rotated while being pressed on the uppermost sheet, thereby to feed the uppermost sheet toward a sloped separation member that is formed at a position downstream to the stacked sheets in a feeding direction. Accordingly, the uppermost sheet is separated from the stacked sheets by the separation member and fed toward the image forming section (refer to JP-A-2005-247521, which is also published as US 2005/0194732 A1).

In the conventional sheet feeding device disclosed in JP-A-2005-247521, the arm is formed by a synthetic resin in a frame shape (or a box shape). The arm is supported by an axis to be rotatable with respect to a drive shaft. The arm is provided with: a driving gear disposed at a position near the base end, the driving gear being configured to rotate integrally with the drive shaft; and a transmission gear train provided at an intermediate portion of the arm in the longitudinal direction, the transmission gear train being configured to transmit power provided from the driving gear to a gear portion that is provided at a side next to the feed roller.

Each of the transmission gears (intermediate gear, or transmission roller) of the transmission gear train is formed with an axis hole at an axis of the rotation. A plurality of spindles, each provided for the respective transmission gears and rotatably supports the respective transmission gears fitted therein, are provided to protrude from an inner surface of one of side plates of the arm.

An elastic member, such as a leaf spring, is provided in the arm to face a side face of each of the transmission gears fitted in the spindles. The transmission gears are pressed into the spindles against an elastic force of the elastic body, to thereby attach the transmission gears in the spindles. According to this configuration, an attachment of the transmission gears is simplified, and the transmission gears once fitted into the spindles are prevented from easily coming off from the spindles.

However, in the configuration disclosed in JP-A-2005-247521, the transmission gears are supported by the spindles protruded from the arm in a cantilevered style. Accordingly, the spindles need to have a considerably large diameter in order to have a rigidity sufficient for withstanding a torque (rotation moment) that acts on the respective spindles when performing a sheet feeding operation.

In a case where the spindle is configured to have the diameter of a large size, a sliding (contact) area where contacts with the axis hole of the transmission gear becomes large, resulting in an increase in frictional force, so that efficiency for driving the transmission gear train is lowered. As a result, a size of the arm needs to be larger, and a drive motor used in the feeding operation is required to have larger torque.

On the other hand, in a case where the transmission gear is configured to have a pair of spindles that protrude from both sides of the transmission gear while supporting the transmission gear by the arm with the pair of spindles, the following configurations will be necessary be employed.

That is, as a first example of the configurations, the arm is configured to be provided with: a first axis hole for supporting one of the pair of spindles is formed on one (first side plate) of side plates of the arm; a second axis hole for supporting the other of the pair of spindles is formed on the other (second side plate) of the side plates that is arranged in parallel with the first side plate; and a means that detachably fix the first and second side plates after the pair of spindles of the transmission gear are inserted into the first and second axis holes. When employing this configuration, the first and the second side plates of the arm need to be formed separable from one another, and the first and second side plates need to be fixed, thereby raising a manufacturing cost.

As a second example of configurations, the first and the second side plates of the arm are arranged in parallel with one another to have a predetermined distance therebetween (the distance is configured to be substantially equal to a width of the transmission gear). The first and second axis holes are formed on the first and second side plates, and an axis hole is formed on the transmission gear. After a spindle is inserted into the first and second axis holes and the axis hole that is formed on the transmission gear, a stopper member is attached for preventing the spindle member from coming off. When employing this configuration, a number of components is increased, and the insertion of the spindle member into the three axis holes becomes troublesome, thereby raising a manufacturing cost required for assembling the arm.

SUMMARY

One of objects of the present invention is to provide a sheet feeding device and an image recording apparatus provided with the sheet feeding device, which has a simple configuration to allow lowering a manufacturing cost including cost required for assembling, and to reduce in size having a high strength, without lowering transmission efficiency by reducing a diameter of a spindle.

According to a first aspect of the present invention, there is provided an image feeding device including: an arm member that is provided with a drive shaft at a base end thereof, the arm member being configured to swingably rotate around the drive shaft in accordance with an amount of a stacked sheets; a feed roller that is disposed at a leading end of the arm member, the feed roller feeding an uppermost sheet of the stacked sheets by being rotated while pressed on the uppermost sheet; and a transmission mechanism that is provided with one or more transmission rollers that transmit power provided from the drive shaft to the feed roller. Each of the transmission rollers is provided with a spindle that protrudes from both side faces thereof along an rotational axis. The arm member is provided with one or more pairs of bearing members for the respective transmission rollers, each of the pairs of the bearing members being faced with each other and being monolithically formed on the arm member.

According to a second aspect of the present invention, there is provided an image forming apparatus including: an image forming unit that forms image on a sheet; and a sheet feeding device. The sheet feeding device includes: an arm member that is provided with a drive shaft at a base end thereof, the arm member being configured to swingably rotate around the drive shaft in accordance with an amount of a stacked sheets; a feed roller that is disposed at a leading end of the arm member, the feed roller feeding an uppermost sheet of the stacked sheets to the image forming unit by being rotated while pressed on the uppermost sheet; and a transmission mechanism that is provided with one or more transmission rollers that transmit power provided from the drive shaft to the feed roller. Each of the transmission rollers is provided with a spindle that protrudes from both side faces thereof along an rotational axis, and wherein the arm member is provided with one or more pairs of bearing members for the respective transmission rollers, each of the pairs of the bearing members being faced with each other and being monolithically formed on the arm member.

DESCRIPTION

Hereinafter, examples of the present invention will be described with reference to the drawings.

Figure 1:
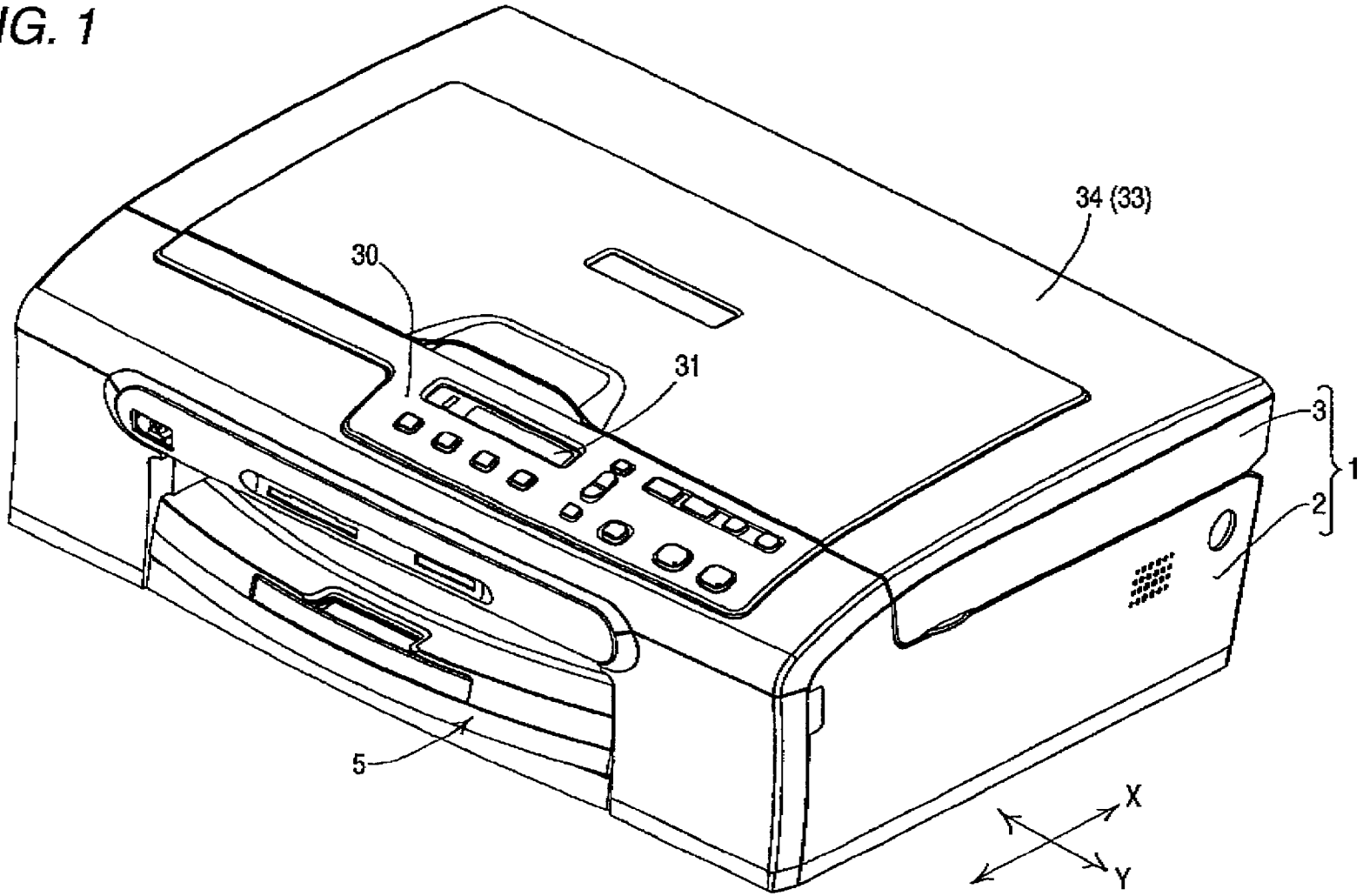
FIG. 1 is an overall perspective view of an image forming apparatus according to an example of the present invention.

An image forming apparatus 1 according to an example of the present invention is shown in FIG. 1. The image forming apparatus 1 is provided with a plurality of functions, such as a fax function, a printer function, a copier function, and a scanner function, so as to be served as a multi-function device (MFD). The image forming apparatus 1 includes a substantially box-shaped main body case 2 that is opened at upper portion thereof, and an upper case 3 that is pivotably attached to the main body case 2 so as to be vertically rotatable around a rotation axis (unillustrated) that is configured by a hinge disposed at a backside along a back face of the main body case 2.

In the description herein, a near side (side where faces to a user) of the image forming apparatus 1 is determined as a front side. A left-and-right direction (primary scanning direction, or Y-axis direction), a back-and-forth direction (secondary scanning direction, X-axis direction), and an up-and-down direction are defined from the front side on the basis of the orientation of the image forming apparatus 1.

The main body case 2 and the upper case 3 are formed by injection-molding a synthetic resin.

An operation panel 30 is arranged on an upper face of the upper case 3 at a position near to the front face. Various types of buttons such as numeric buttons, a start button, and functional operation buttons are provided on the operation panel 30. By pressing the buttons, various types of operations are performed by the image forming device 1. A display unit 31 including a display device, such as a liquid crystal display (LCD), is provided on the operation panel 30. The display unit 31 appropriately displays configuration status of the image forming apparatus 1 and various types of operation messages.

In the upper case 3, a scanner device (image scanning section) 33 is arranged at a position rear to the operation panel 30. The scanner device 33 scans images of a document to be transmitted to another fax machine when performing the fax function, or of a document to be copied when performing the copier function. The scanner device 33 is provided with: a flat-bed scanner section that scans images of the document placed on a large-sized glass plate; and a rotatable cover 34 that covers an upper surface of the flat-bed scanner section.

Although not shown in the accompanying drawings, a contact image sensor (CIS), which serves as a photoelectric transducer for scanning an image of the document placed on the glass plate, is provided beneath the glass plate in the flat-bed scanner section. The contact image sensor is configured to be movable along a guide shaft that is disposed to extend in a direction parallel to a moving direction (primary scanning direction, Y-axis direction) of a carriage that is described later.

The cover 34 is pivotably attached to the hinge disposed at the backside of the image forming device 1 so as to be vertically rotatable around the hinge.

Next, a configuration of a printer device (image forming section) will be described. As shown in FIG. 1, a sheet feeding cassette 5 is disposed at a lower center portion of the main body case 2 to be removable therefrom at an opening portion 2*a* formed at the front face of the main body case 2. The sheet feeding cassette 5 stores a plurality of sheets P that are horizontally stacked with one another.

A feed roller unit 6, which serves as a sheet feeding device, is provided in the main body case 2 at a position above the sheet feeding cassette 5. The feed roller unit 6 is provided with feed rollers 7, a sheet conveying path, and an image forming unit 10 (see FIG. 3). The sheet conveying path is configured to have a substantially laterally-facing U-lettered shape, when viewed from a side of the image forming device 1, at the backside of the main body case 2. The feed roller unit 6 conveys the sheet P stored in the sheet feeding cassette 5 toward the front face of the image forming device 1 along the sheet conveying path. The image forming unit 10 is provided with an inkjet print head 12 that forms image by ejecting ink on the sheet P placed on a platen 11 that is disposed to face the sheet conveying path. The platen 11 serves as a sheet supporting section being formed in a plate shape and supporting the sheet P thereon.

A plurality of ink cartridges 26 are disposed in an accommodating section 27 to be removable upwardly therefrom, The ink cartridges 26 supply ink to the print head 12 that performs printing colored image. The accommodating section 27 is provided in the main body case 2 at a position close to the front face and to a right sidewall (Note that the front face of the image forming device 1 is positioned right in FIG. 2).

Each of the ink cartridges 26 stores ink for respective colors, which are four colors of black, cyan, magenta, and yellow in the example. The image forming device 1 may be configured to have a larger number of ink cartridges 26. The ink is supplied from each of the ink cartridges 26 to the print head 12 through a flexible ink tube 28 that connects the ink cartridges 26 and the print head 12.

Figure 2:
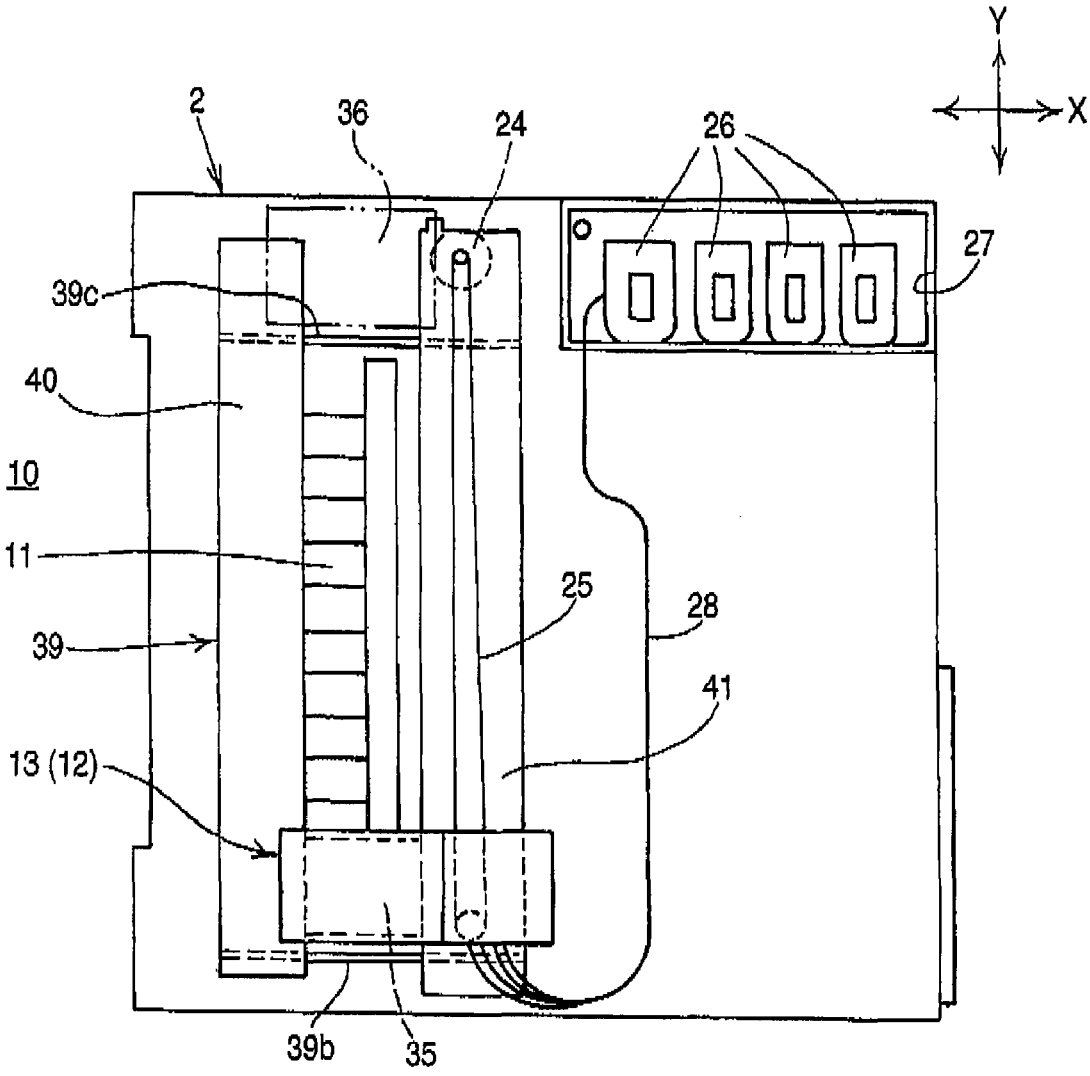
FIG. 2 is a plan view of a main body case from which an upper case is removed.
Figure 3:
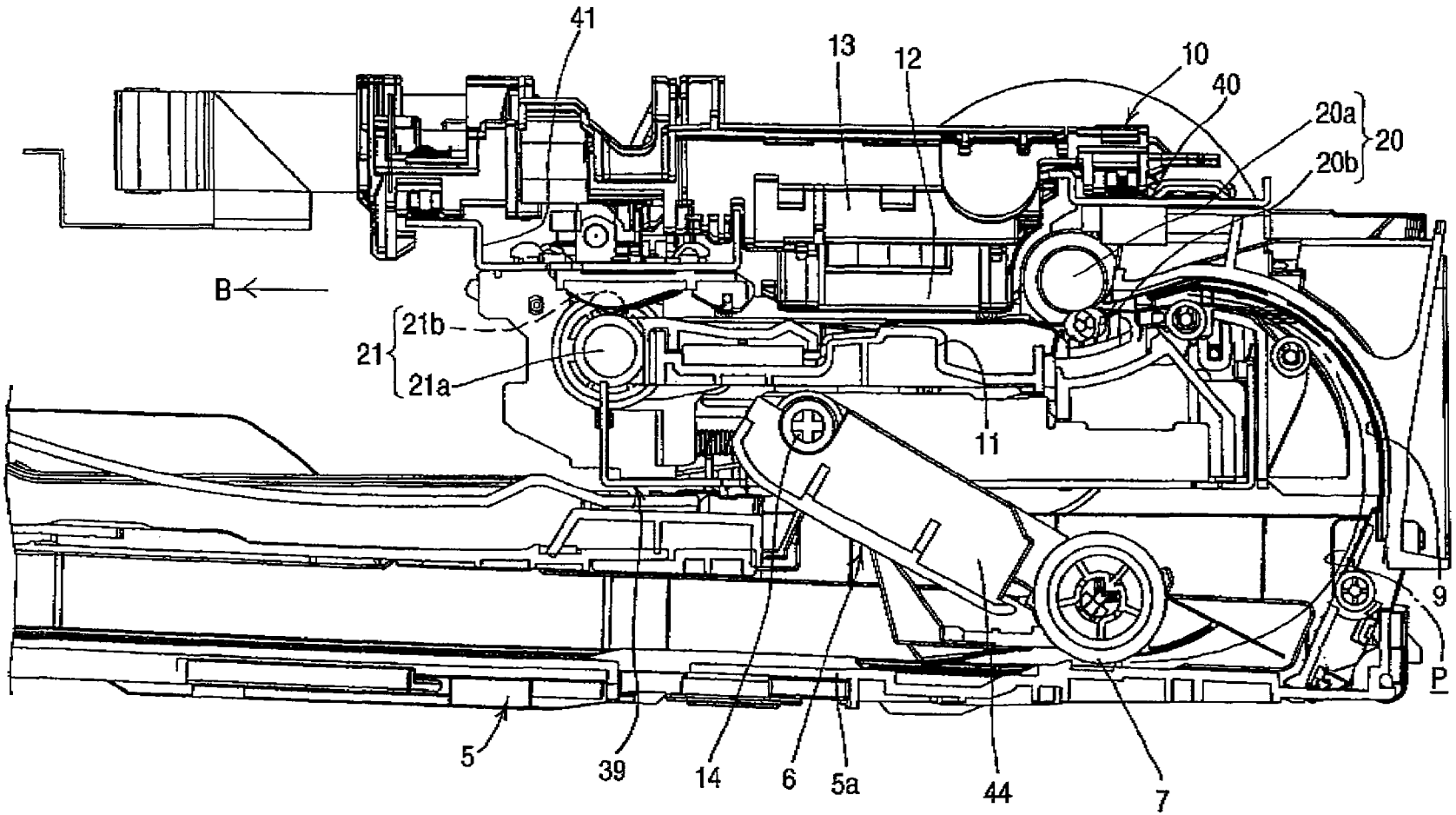
FIG. 3 is a side sectional view of a left and right center portion of an image forming section.
Figure 4:
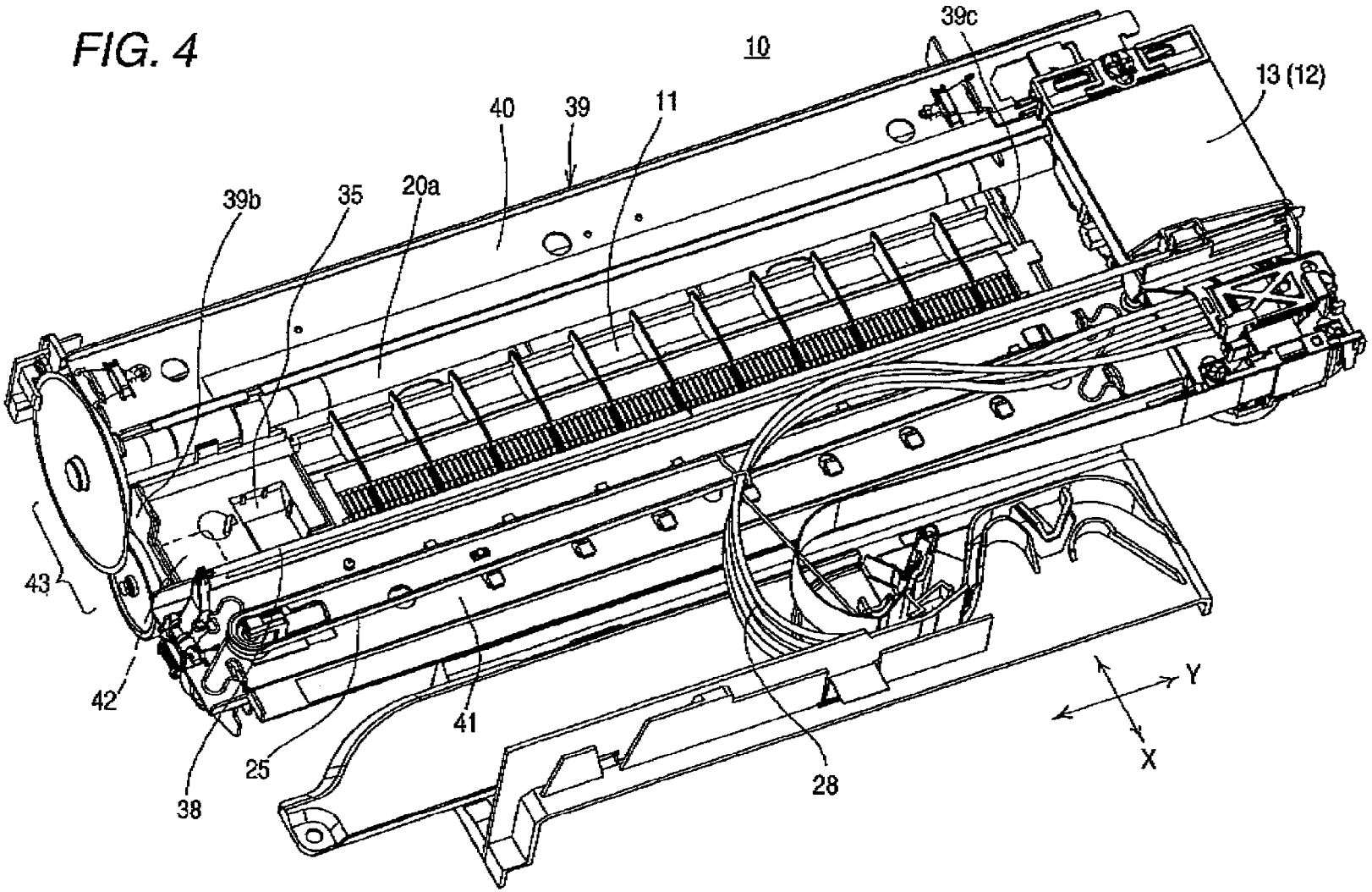
FIG. 4 is a perspective view of the image forming section.

As shown in FIGS. 2-4, the image forming unit 10 includes: a carriage 13 that carries the print head 12; the platen 11 that is made of a synthetic resin in a plate shape; a CR (carriage) motor 24 that moving the carriage 13 back and forth; a timing belt 25 that is connected to the CR motor 24; and a frame 39 that is made of metal plates and supports the members included in the image forming unit 10.

The frame 39 is disposed at the backside in the main body case 2 above the sheet feeding cassette 5. The frame 39 serves as a support frame, and is equipped with, at an upper side of a main portion having a box shape, a pair of guide plates 40 and 41 that extends in the left-and-right direction (primary scanning direction, Y-axis direction) of the main body case 2. The guide plates 40 support the carriage 13 that slides thereon.

The guide plate 41, which is disposed on a downstream side in a conveying direction, is provided with a linear encoder (encoder strip) 38 so as to extend along a longitudinal direction 15 (primary scanning direction) of the guide plate 41. A position of the carriage 13 in the Y-axis direction (primary scanning direction) is detected by the linear encoder 38. The linear encoder 38 is configured so that a detection surface (the surface where slits are formed at fixed intervals in the Y-axis direction) is disposed vertically.

An ink receiving unit 35 and a maintenance unit 36 are respectively disposed at each of side areas next to an area where the sheet P is conveyed having a width (shorter side edge) of the sheet P. In the present example, the ink receiving unit 35 is disposed on the main portion of the frame 39 at a position close to a left side plate 39*b*, and the maintenance unit 36 is disposed at a position near to a right side plate 29*c*.

The print head 12 periodically ejects ink, to prevent a nozzle from clogging, during a image forming operation at a flushing position defined in the ink receiving unit 35, and the ink receiving unit 35 receives the ejected ink.

In the maintenance unit 36, a position where the carriage 13 is located at rightmost in FIG. 4 in the primary scanning direction (Y-axis direction) is defined as an original position. A position where the carriage 13 is moved leftward from the original position in the Y-axis direction is defined as a maintenance position that also serves as a standby position.

At the maintenance position, a cap (unillustrated) is disposed in the maintenance unit 36 to cover a nozzle surface of the print head 12 from below the print head 12.

An LF motor 42, which is disposed in the maintenance unit 36, is driven to actuate a suction pump (unillustrated) so as to selectively suction ink from the nozzle and perform a recovering treatment for removing air bubbles in a buffer tank on the print head 12. When the carriage 13 moves from the maintenance unit 36 toward an image forming area in the Y-axis direction (primary scanning direction), a cleaning member (wiper blade), which is not shown, wipes and cleans the nozzle surface of the print head 12.

A pair of registration rollers (conveyance rollers) 20 is arranged at an upstream side in the conveying direction with respect to the platen 11, the registration rollers 20 being configured to convey the sheet P to a lower surface of the print head 12. A pair of discharge rollers 21 is arranged at a downstream side in the conveying direction with respect to the platen 11, the discharge rollers 21 being configured to convey the printed sheet P toward a sheet discharge section (see an arrow B shown in FIG. 3).

One of the registration rollers 20 is configured as a driving roller 20*a* that is applied with a driving force, and the other of the registration rollers 20 is configured as a driven roller 20*b* that is disposed below the driving roller 20*a*. One of the discharge rollers 21 is configured as a driving roller 21*a* that is applied with a driving force, and the other of the discharge rollers 21 is configured as a driven roller 20*b* that is disposed above the driving roller 21*b*.

Both end portions of the driving roller 20*a* and both end portions of the driving roller 21*a* are rotatably supported by axis support portions provided on the pair of side plates 39*b* and 39*c* of the frame 39. The sheet P is nipped between the driving roller 20*a* and the driven roller 20*b*, and between the driving roller 21*a* and the driven roller 21*b*, when conveyed along the sheet conveyance path.

A gear transmission mechanism 43 transmits driving force provided by a single LF motor (sheet conveying motor) 42 to the driving roller 20*a*, the driving roller 21*a*, and the maintenance unit 36 (see FIG. 4). The LF motor 42 is disposed at a position near the side plate 39*b* that is disposed at a side opposite to that where the maintenance unit 36 is disposed.

Figure 5:
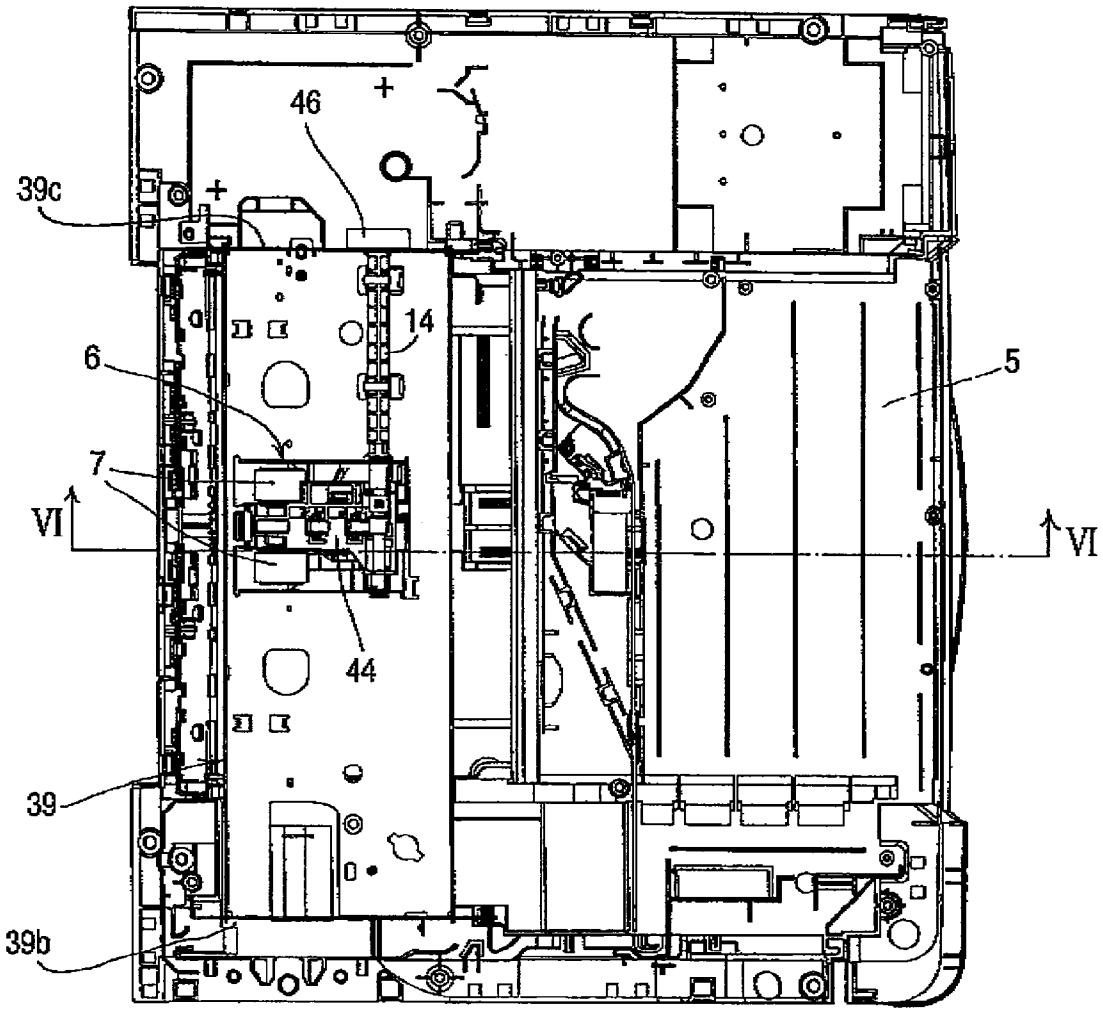
FIG. 5 is a plan view showing an frame and components below the frame.

The driving force (torque) provided by the LF motor 42 is transmitted from one end of the driving roller 20*a* to a gear 46 (see FIGS. 5 and 7) of a drive shaft 14 in the feed roller unit 6 via a power transmission switching mechanism (not shown) for switching the transmission of the driving force to the maintenance unit 36.

A rotary encoder is disposed at a part of the gear transmission mechanism 43. The rotary encoder detects a conveyance amount of the sheet P conveyed by the pair of conveying rollers 20. The CR motor 24 and LF motor 42 are both configured to be rotatable bi-directionally.

Next, referring to FIG. 2 and FIG. 5 to FIG. 10, a structure of the feed roller unit 6, which serves as a sheet feeding device, will be described in detail.

The feed roller unit 6 is provided with: an arm member 44 that is formed by molding a synthetic-resin material; the drive shaft 14; the feed rollers 7; and a transmission mechanism 45 that is assembled in the arm member 44. The transmission mechanism 45 transmits the torque of the drive shaft 14 to the feed rollers 7. The transmission mechanism is provided with a 25 plurality of transmission rollers as will be described later.

A plurality of (four, in the present example) intermediate gears 47 (individually, denoted with reference symbols 47*a*, 47*b*, 47*c*, and 47*d*) serves as a transmission rollers that are attachable to the arm member 44. Each of the intermediate gears 47 is formed by molding a synthetic resin, such as polyamide resin. Each of the intermediate gears 47 is provided with: a main body portion 49 that is formed with teeth at an outer circumferential surface thereof; a boss portion 50 that is formed to have a large diameter and to protrude from both of left and right face of the main body portion 49; and a spindle 51 that is formed to protrude from both ends of the boss portion 50 to have an axis same with that of the boss portion 50 (see FIG. 11A and FIG. 12).

An axis hole 52 is formed at a base end of the arm member 44 for rotatably supporting the drive shaft 14. A rotating shaft 53, on which a driven gear 53*a* is monolithically formed, is provided at a front end side (leading end side) of the arm member 44 to be rotatably supported by an axis hole 54. The pair of feed rollers 7 are attached to both ends of the rotating shaft 53 (see FIGS. 7, 8, and 10).

A gear box 55 having an open structure is provided in the arm member 44 at a position halfway in a longitudinal direction of the arm member 44. The intermediate gears 47*a*, 47*b*, 47*c*, and 47*d* are rotatably supported in the gear box 55 to be engaged one another. The gear box 55 is provided with a pair of bearing members 60 that support both ends of the spindle 51 of each of the intermediate gears 47, the bearing members 60 being formed monolithically with the gear box 55.

The first intermediate gear 47*a* of the transmission mechanism 45 is kept to be engaged with the driving gear 14*a* that integrally rotates with the driving shaft 14. The torque applied to the first intermediate gear 47*a* is transmitted to the driven gear 53*a* of the feed roller 7 via the second intermediate gear 47*b*, the third intermediate gear 47*c*, and the fourth intermediate gear 47*d*.

Each of the bearing members 60 is formed in a pillar shape, and is provided with, at a leading end side thereof, an axis support groove 61 that supports at least a part of the circumferential surface of each side of the spindle 51. The axis support groove 61 is formed to have a U-lettered shape in cross-section, and is formed with an opening 62 that allows each of the intermediate gears 47 attachable and detachable in a direction that is orthogonal to an axis A1 of each of the intermediate gears 47, and toward a leading end of each of the bearing members 60 (see FIGS. 10, 11A, and 12).

The opening 62 formed in each of the bearing members 60 are also opened to a side opposed to the mating one of the bearing members 60.

Each of the intermediate gears 47, is pressed toward a bottom of the axis support groove 61 of the respective bearing members 60 in a direction that is orthogonal to the axis A1, while inserting the spindle 51 between the bearing members 60, whereby both sides of the spindle 51 are supported by the pair of axis support grooves 61.

As described above, each of the intermediate gears 47 has the spindle 51 protruding from both side faces along the axis A1, and the pair of bearing members 60 are formed in the arm member 44 to oppose with each other for rotatably supporting the spindle 51 at its both ends. Accordingly, the spindle 51 is configured to have a small diameter while maintaining adequate rigidity for transmitting torque, whereby a frictional resistance at the axis support grooves 61 is kept small to improve efficiency of the transmission mechanism 45 in transmitting torque.

Figure 11A:
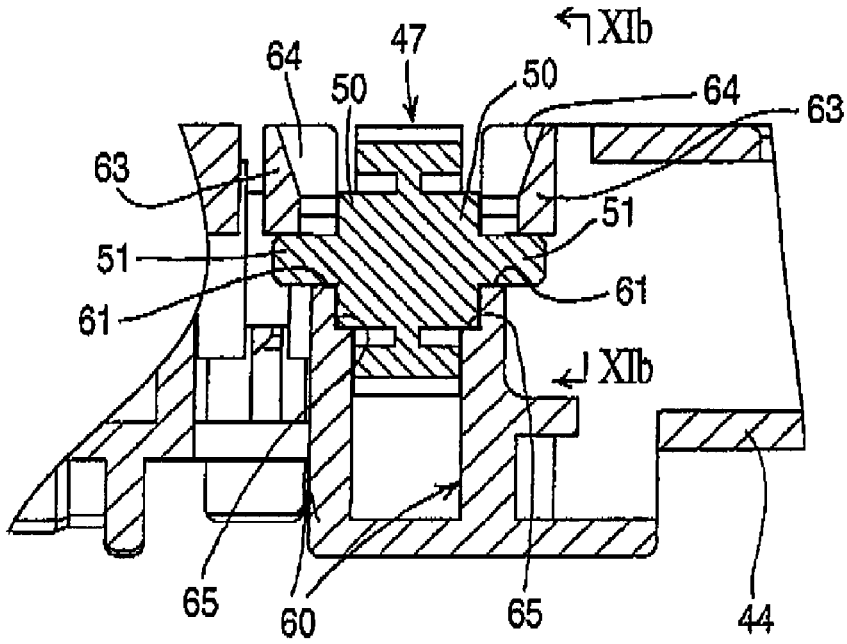
FIG. 11A is an enlarged sectional view taken along a line XIa-XIa shown in FIG. 10.
Figure 12:
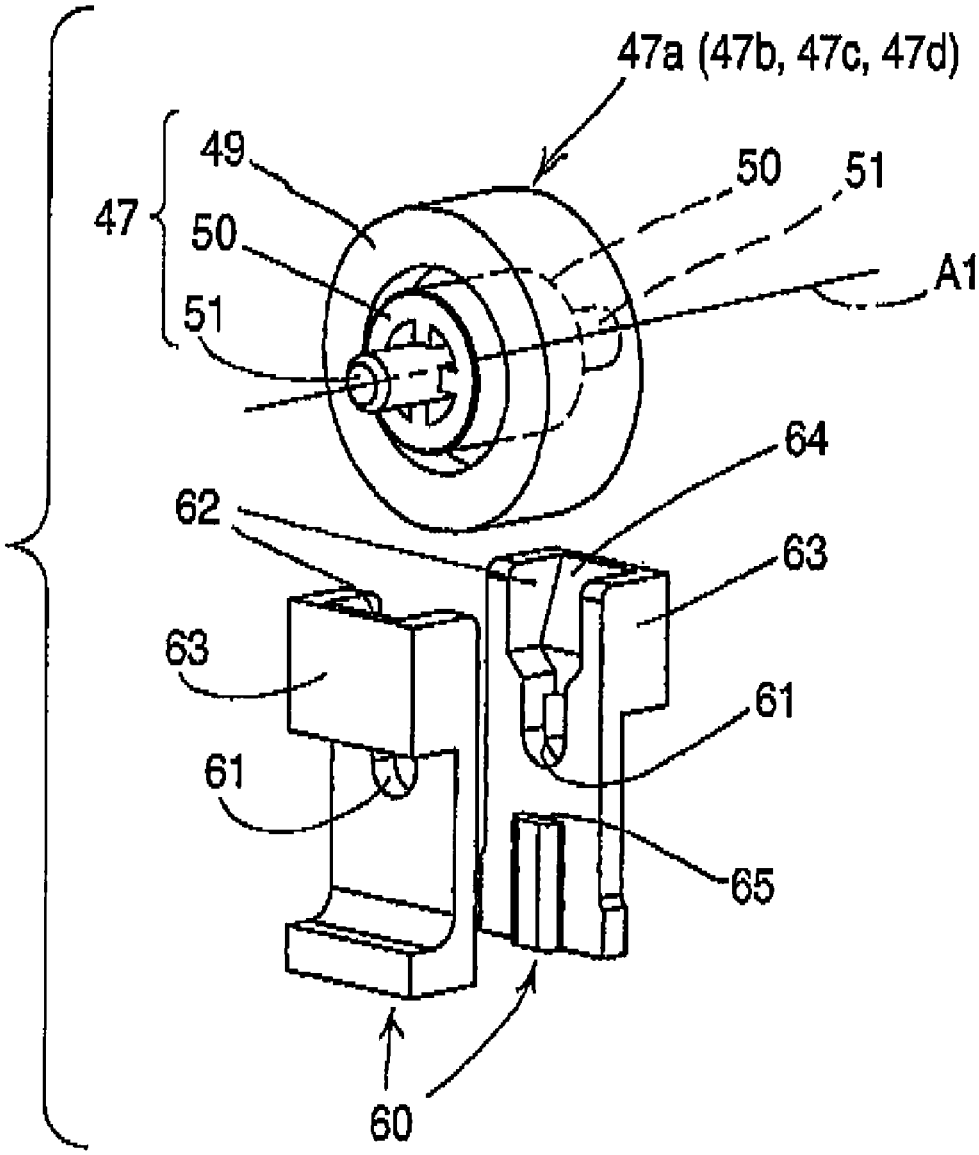
FIG. 12 is a perspective view of an intermediate gear, as one of transmission rollers, and a bearing member.

A retaining piece 63 is monolithically formed on each of the bearing members 60 at a position adjacent to the axis support groove 61 and the opening 62 (see FIGS. 11A and 12). The retaining piece retains the spindle 51 in the axis support groove 61 by abutting a part of the outer circumferential surface of the spindle to prevent the spindle 51 from dropping out toward a direction orthogonal to the axis A1.

Figure 11B:
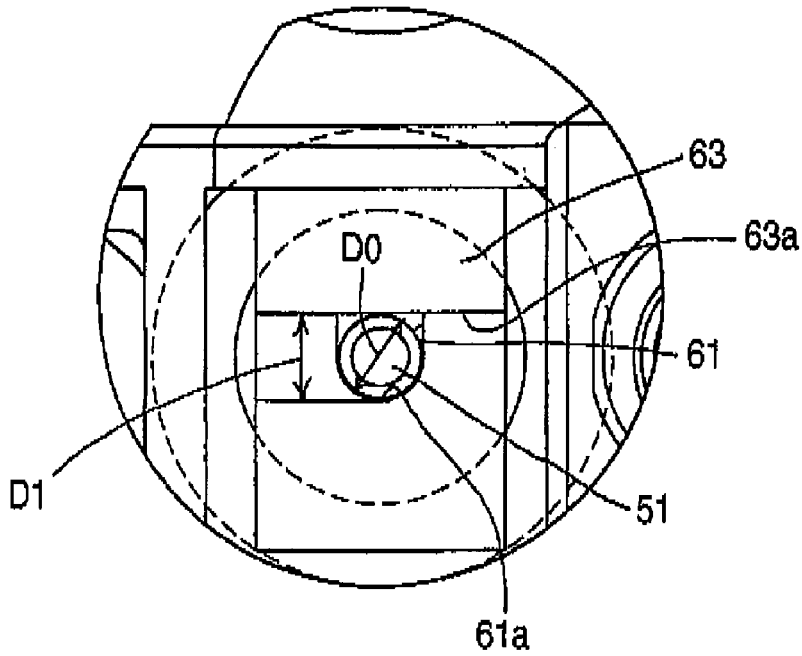
FIG. 11B is an enlarged sectional view taken along a line XIb-XIb shown in FIG. 11.

By setting a distance D1 in a height direction between a retaining face 63*a* of the retaining piece 63 and a bottom surface 61*a* at a bottom portion of the axis support groove 61 so as to be slightly larger than a diameter D0 or equal to each other (see FIG. 11B), the spindle 51 can be supported in a freely rotatable condition.

At least one of the pair of bearing members 60 is formed to be elastically bendable in a direction to which the rotational axis A1 extends. That is, an interval between the pair of the bearing members 60 is expandable at the leading end (free end) of the bearing members 60 due to the elastic characteristic of the synthetic resin material of which the bearing members 60 are made, while the base end of the bearing members 60 is monolithically formed on the arm member 44 being fixed thereto.

According to this configuration, each of the intermediate gears 47 is attached into to the pair of bearing members 60 extremely simply by applying an external force to expand the interval between the pair of bearing members 60 at the leading end. The external force is applied by pushing the intermediate gear 47 in between the pair of openings 62 so that both sides of the spindle 51 proceed in the direction substantially orthogonal to the axis A1.

Figure 10:
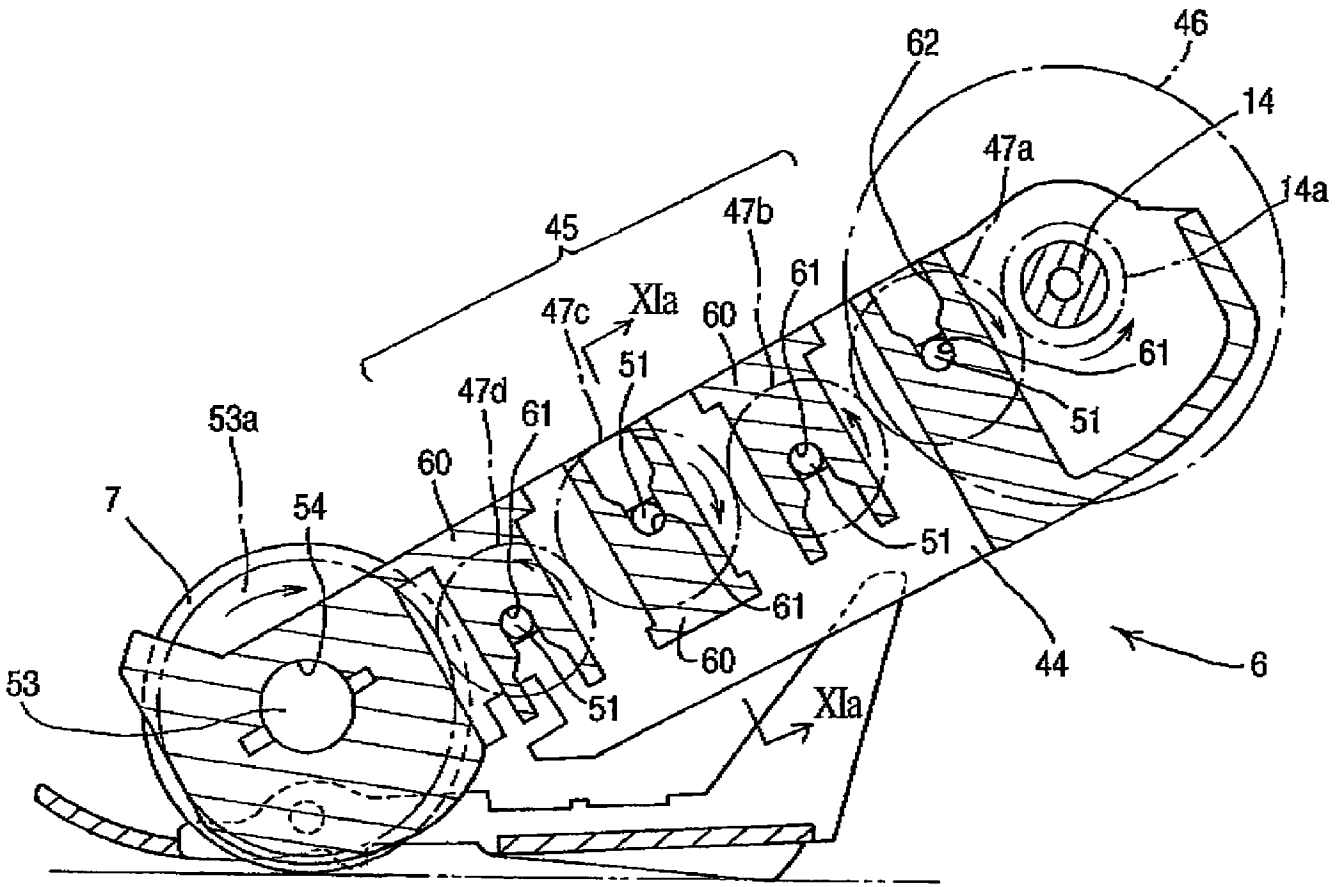
FIG. 10 is a side sectional view taken along a line X-X shown in FIG. 8.

An inclined guide face 64 that guides the spindle 51 toward an inserting direction (direction substantially orthogonal to the axis A1) is formed on each of inner surfaces of at least one of the respective openings 62 and the respective retaining piece 63 (see FIGS. 10, 11A, and 12). The inclined guide face 64 easily allows inserting the both ends of the spindle 51 into the pair of axis support grooves 61 formed on the pair of bearing members 60.

As shown in FIGS. 10, 11A, 11B, and 12, a bottom portion (bottom surface 61*a*) of the axis support groove 61 is formed at a side to support an external force that acts in the direction orthogonal to the axis A1 on each intermediate gear 47 when the feed rollers 7 performs feeding the sheet P.

Figure 7:
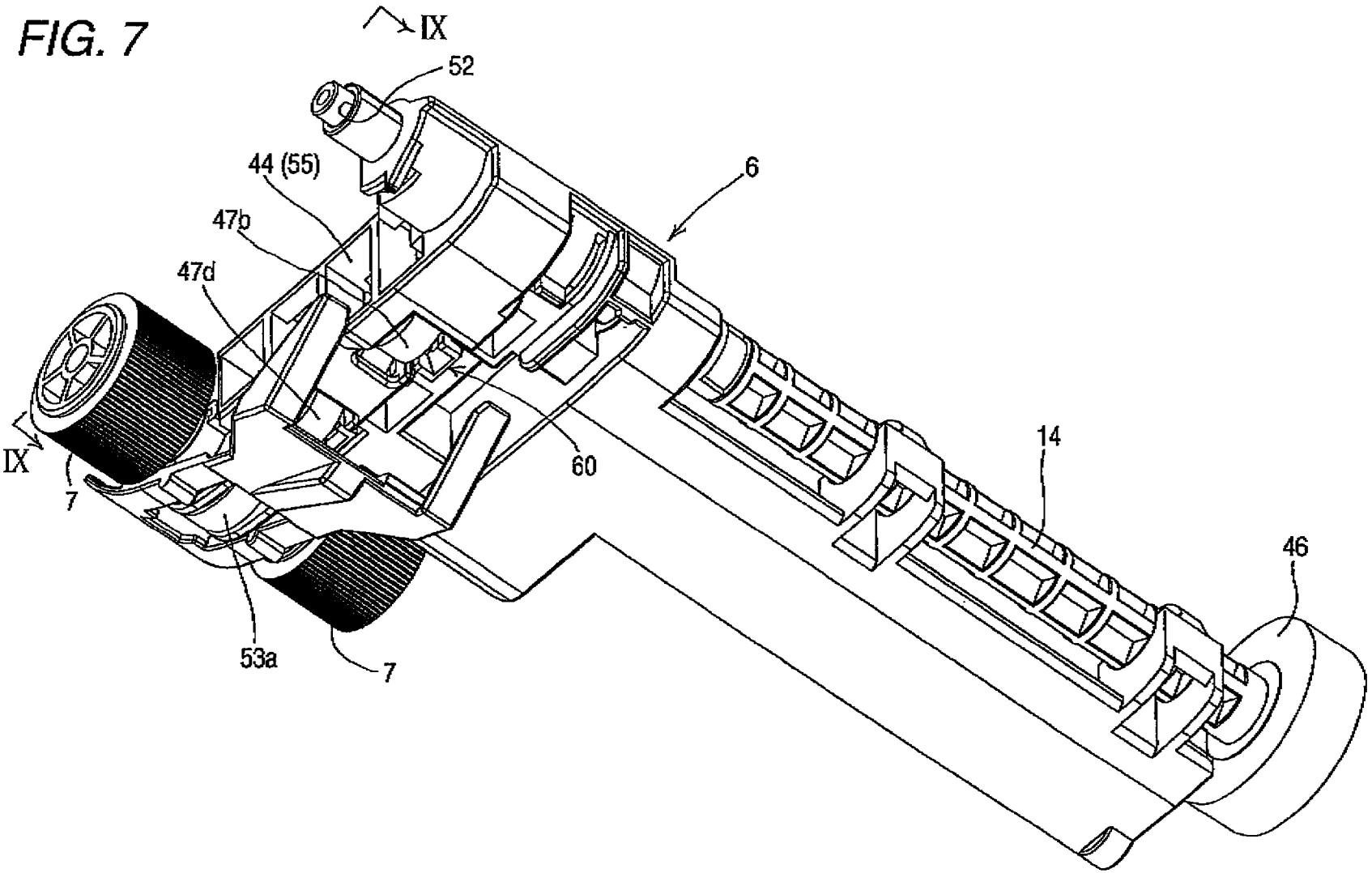
FIG. 7 is a perspective view from a lower surface side of a feed roller unit and an alienating means.
Figure 8:
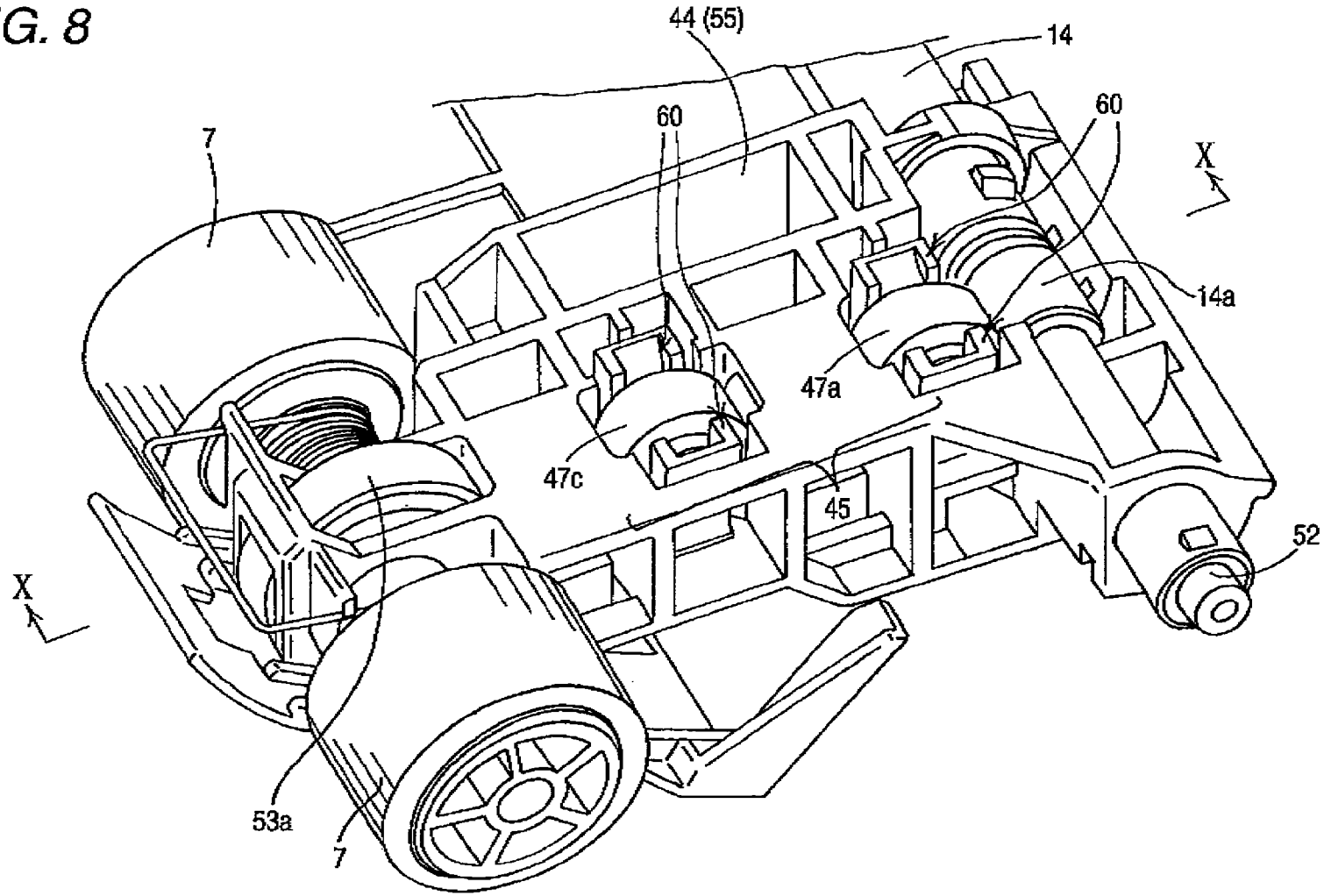
FIG. 8 is a perspective view from an upper surface side of a feed roller unit and the alienating means.

For example, referring to FIG. 7, in a case where the feed rollers 7 rotate clockwise for feeding the sheet P, the drive shaft 14 rotates counterclockwise, and the first intermediate gear 47*a* rotates clockwise. In sequence, the rotation direction reverses alternately, such that the second intermediate gear 47*b* rotates counterclockwise, the third intermediate gear 47*c* clockwise, the fourth intermediate gear 47*d* rotates counterclockwise, and the driven gear 53*a* of the feed rollers 7 rotates clockwise.

A driving torque acts in the rotation direction on the spindle 51 of the each of the intermediate gears 47. In order to accept the driving torque, the bearing members 60 are arranged so that the bottom portions (bottom surface 61*a*) of the axis support grooves 61 that respectively support the first intermediate gear 47*a* and the third intermediate gear 47*c* are located above the spindles 51, while the bearing members 60 are arranged so that the bottom portions (bottom surface 61*a*) of the axis support grooves 61 that respectively support the second intermediate gear 47*b* and the fourth intermediate gear 47*d* are located below the spindles 51 (see FIG. 10). Thereby, each of the intermediate gears 47 can be reliably supported even when configured that the spindle 51 is removable from the leading end of each of the axis support grooves 61 due to existence of the opening 62.

The driving torque, which acts on an arbitrary one of the intermediate gears 47 at the time of normal rotation for feeding the sheet P, is far greater than the driving torque, which acts on the same one of the intermediate gears 47 at the time of reverse rotation for performing non-feed operation. Accordingly, by forming the bearing members 60 on the arm member 44 so that the bottom portions (bottom surface 61*a*) of each of the axis support grooves 61 are located at the side to receive the driving torque when feeding the sheet P, a size of each of the bearing members 60 having a pillar shape can be reduced while keeping a required strength for the pair of bearing members 60, whereby the arm member 44 can be reduced in size.

By inserting the spindle 51 of each of the intermediate gears 47 from the side that requires no supporting strength by the spindle 51 of each of the intermediate gears 47, from the side where the opening 62 is formed, it becomes possible to attach the intermediate gears 47 to the arm member 44 with a small number of components while having the structure to have the spindle 51 supported 51 at its both ends.

Furthermore, the configuration, in which the free end side (side where the opening 62 exists) of the bearing members 60 is configured to be bendable, also provides an advantage that all of the intermediate gears 47 are attached easily into the respective bearing members 60.

Positions where the axis support grooves 61 are formed are biased so that, with respect to a position of the spindle 51 in the intermediate gear 47 disposed at an upstream side in the transmission of the torque, a position of the spindle 51 in the intermediate gear 47 disposed at a downstream side adjacent thereto is offset at an appropriate amount (T1) in a direction opposite a direction of a rotation moment applied by the adjacent transmission roller disposed at upstream side.

Figure 9:
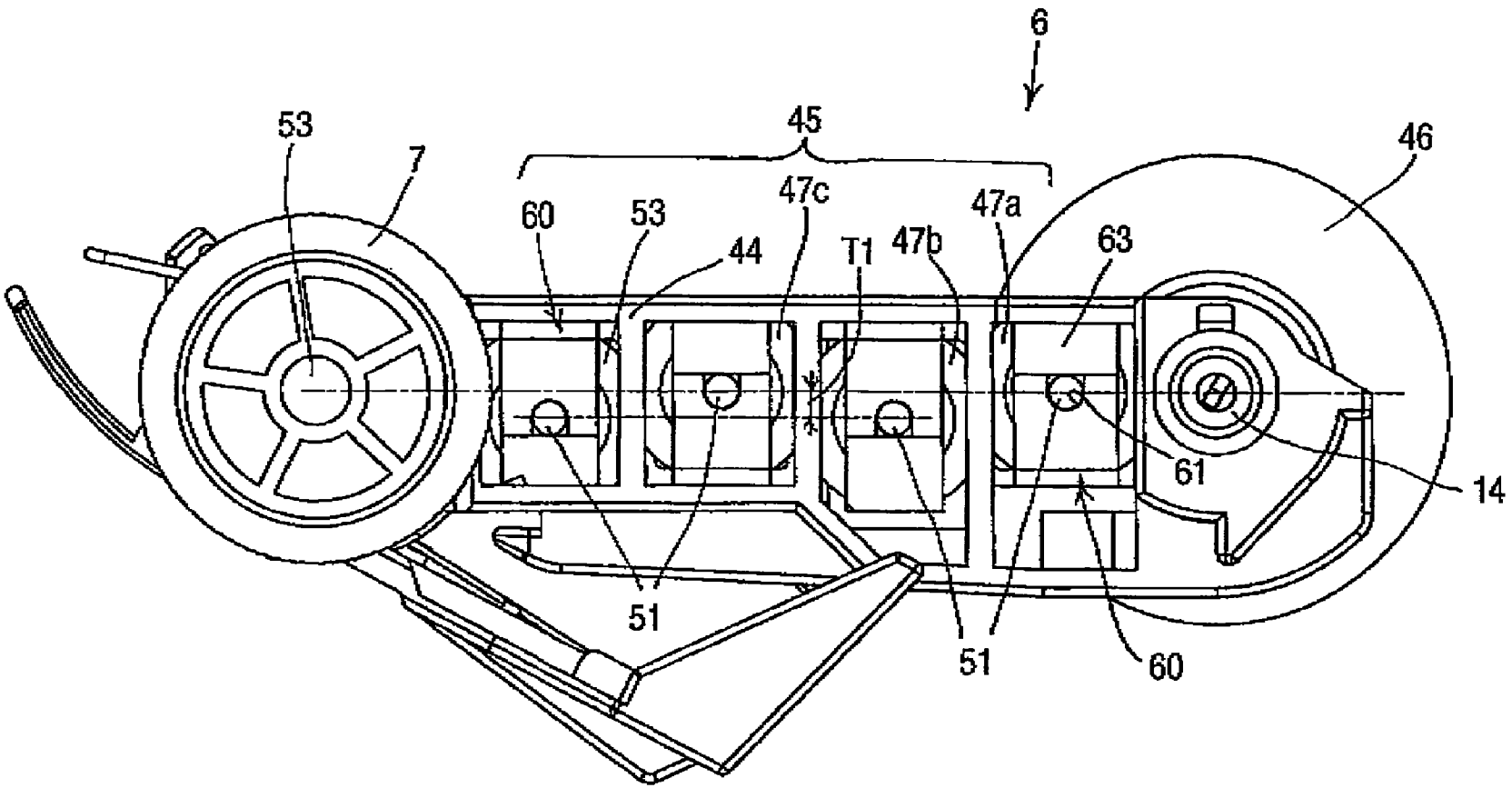
FIG. 9 is a side view from a direction shown by a line IX-IX shown in FIG. 7.

For example, as shown in FIGS. 9 and 10, with regard to the first intermediate gear 47*a* that rotates clockwise, the second intermediate gear 47*b* at the downstream side engaged therewith receives a counter clockwise rotation moment (torque). Moreover, with regard to the second intermediate gear 47*b* at the driving upstream side, the third intermediate gear 47*c* at the driving downstream side receives a clockwise rotation moment. The same applies to the following intermediate gears 47*d*. In this case, with the offset as described above, as a result of an arrangement so as to have the distance T1 in downward from the center of the spindle 51 of the second intermediate gear 47*b* to a line connecting centers of the spindles 51 of the first intermediate gear 47*a* and the third intermediate gear 47*c*, the dimension of a diameter of a reference pitch circle of the second intermediate gear 47*b* is slightly larger than the distance between both spindles 51 of the first intermediate gear 47*a* and the third intermediate gear 47*c*. Accordingly, tooth engagement of the adjacent intermediate gears 47 with each other can be prevented from loosening.

However, when a load (overload), which is larger than that predetermined, is acted on any one of the intermediate gears 47, an elastic deformation occurs so as to expand the interval between the pair of bearing members 60 at the leading end. Consequently, the intermediate gear 47 sinks down between the pair of bearing members 60 toward the base end side of the bearing members 60. When the overload is acted, a circumferential surface of the boss portion 50 of the intermediate gears 47 contacts with a stepped portion 65 (see FIGS. 11A and 12) monolithically formed on the inner surface of the pair of bearing members 60, whereby the intermediate gear 47 is prevented from sinking down toward the base end side of the bearing members 60, and moreover, damage to the bearing members 60 can be avoided.

The main body portion of the frame 39 is equipped with the feed roller unit 6 so as to be freely rotatable around the drive shaft 14. The arm member 44 is urged to swing downward by an urging member, such as a torsion spring. When feeding the sheets P separately one by one from the sheets stacked in the feeding cassette 5, the LF motor 43 reversely rotates, and the drive shaft 14 normally rotates (clockwise direction in FIG. 3) via the maintenance unit 36.

Since the arm member 44 is urged to swing downward by the urging force of the urging member, the feed rollers 7 disposed at the leading end of the arm member 44 are pressed on the uppermost sheet P of the sheets stacked in the sheet feeding cassette 5, and the feed rollers 7 are rotated in the feeding direction (counterclockwise direction in FIG. 3) by the transmission mechanism 45 provided in the arm member 44.

Figure 6:
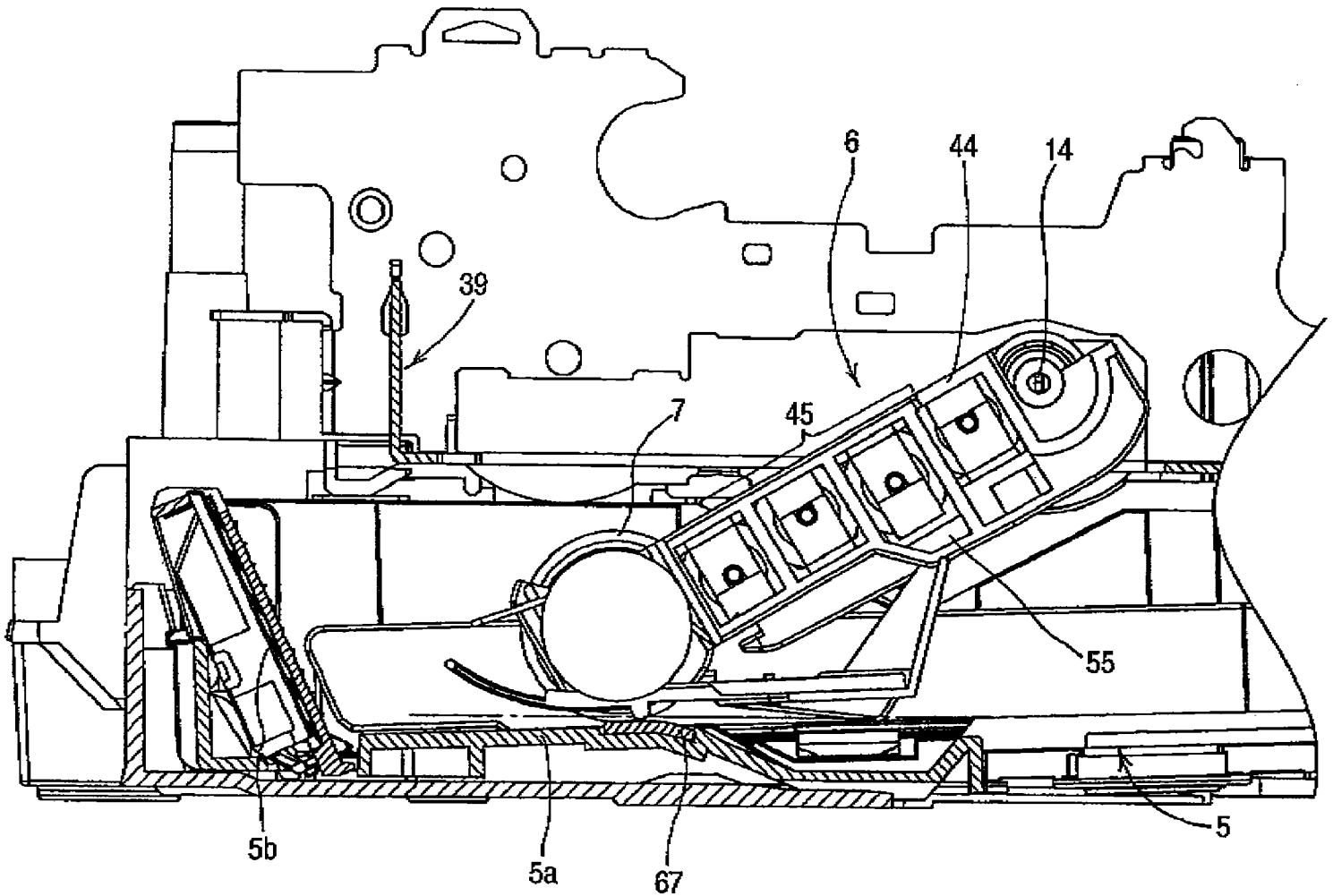
FIG. 6 is a partial-cutaway side sectional view along a line VI-VI shown in FIG. 5.

The feed rollers 7 rotate clockwise in FIG. 6 by the transmission mechanism 45 and the driven gear 53*a* so as to engage the sheet P to an inclined separating plate 5*b* arranged at the front end (an end portion shown left in FIG. 6) of the sheet feeding cassette 5. Only the uppermost sheet P is separated by an elastic separation pad (which is made of a leaf spring in the present example), which serves as a separating member, provided at a center part in the inclined separating plate 5*b*. Thereafter, the sheet P is conveyed to the image forming section along the sheet conveying path 9.

When not performing the feeding of the sheet P, the LF motor 42 normally rotates to rotate the drive shaft 14 reversely, and the arm member 44 lifts up from the stacked sheets against the urging force of the urging member such as a torsion spring.

The present invention is not limited to the example described above, and various modifications can be made within a scope not deviating from the spirit of the present invention.

For example, as the feed roller, a pair of left and right feed rollers 7 or only one feed roller 7 may be employed, Moreover, the outer circumferential surface of the feed roller 7 may be formed of a member having a large friction coefficient such as rubber, and in a bottom plate 5*a* of the sheet feeding cassette 5, at a position facing the outer circumferential surface of each feed roller 7, a base pad 67 formed likewise of a high-friction coefficient member (for example, cork or the like) may be fixedly attached (adhered) (see FIG. 6).

Furthermore, as the transmission roller, a friction wheel may be employed besides a gear. Moreover, as a matter of course, the invention can also be applied to a plate-like feed section provided in an inclined standing condition in the rear of the main body case 2, besides the sheet feeding cassette 5 arranged so as to be movable to be inserted and removed in a roughly horizontal direction with respect to the main body case 2 described above.

What is claimed is:

1. A sheet feeding device comprising:

an arm member that is provided with a drive shaft at a base end thereof, the arm member being configured to swingably rotate around the drive shaft in accordance with an amount of a stacked sheets;

a feed roller that is disposed at a leading end of the arm member, the feed roller feeding an uppermost sheet of the stacked sheets by being rotated while pressed on the uppermost sheet; and a transmission mechanism that is provided with a plurality of transmission rollers that transmit power provided from the drive shaft to the feed roller, wherein each of the transmission rollers is provided with a spindle that protrudes from both side faces thereof along a rotational axis, wherein the arm member is provided with a plurality of pairs of bearing members for the respective transmission rollers, each of the pairs of the bearing members being faced with each other and being monolithically formed on the arm member, wherein each of the bearing members is formed with an opening that allows the respective transmission rollers to be attachable in a direction orthogonal to the rotation axis, and the bearing members comprise a first bearing member rotatably supporting a first transmission roller and a second bearing member rotatably supporting a second transmission roller, the second bearing member adjacent to the first bearing member, wherein the opening of the first bearing member opens in a first direction and the opening of the second bearing member opens in a second direction opposite to the first direction, and wherein at least one of each of the pairs of the bearing members is formed to be elastically bendable in a direction to which the rotation axis extends.

2. The sheet feeding device according to claim 1, wherein each of the bearing members is provided with an axis support groove that supports at least a part of a circumferential surface of the respective spindle, wherein the axis support groove is formed with the opening that allows the transmission roller to be attachable in a direction orthogonal to the rotational axis, and wherein each of the bearing members is provided with a retaining piece that is formed at a position adjacent to the axis support groove and the opening, the retaining piece retaining the respective spindle in the axis support groove.

3. The sheet feeding device according to claim 2, wherein a bottom face of the axis support groove is formed at a side to support an external force that acts in the direction orthogonal to the rotational axis when feeding the sheet by rotating the feed roller.

4. The sheet feeding device according to claim 1, wherein at least one of each of the pairs of the bearing members is fixed on the arm member at a base end thereof to be bendable at a leading end in the direction to which the rotational axis extends.

5. The sheet feeding device according to claim 2, wherein at least one of the opening and the retaining piece is formed with an inclined guide face that guides the respective spindle into the axis support groove.

6. The sheet feeding device according to claim 1, wherein, with respect to a position of the spindle of one of the transmission rollers that is disposed upstream in a direction the power is transmitted, a position of the spindle of adjacent one of the transmission rollers that is disposed downstream is offset in a direction opposite a direction of a rotation moment applied by the adjacent upstream transmission roller.

7. The sheet feeding device according to claim 1, wherein the arm member and the bearing members are monolithically formed of a synthetic resin material.

8. The sheet feeding device according to claim 1, wherein each of the transmission rollers is a gear that is formed of a synthetic resin material monolithically with the spindle.

9. An image forming apparatus comprising:

an image forming unit that forms image on a sheet; and a sheet feeding device that comprises:

an arm member that is provided with a drive shaft at a base end thereof, the arm member being configured to swingably rotate around the drive shaft in accordance with an amount of stacked sheets;

a feed roller that is disposed at a leading end of the arm member, the feed roller feeding an uppermost sheet of the stacked sheets to the image forming unit by being rotated while pressed on the uppermost sheet; and a transmission mechanism that is provided with a plurality of transmission rollers that transmit power provided from the drive shaft to the feed roller, wherein each of the transmission rollers is provided with a spindle that protrudes from both side faces thereof along a rotational axis, wherein the arm member is provided with a plurality of pairs of bearing members for the respective transmission rollers, each of the pairs of the bearing members being faced with each other and being monolithically formed on the arm member, wherein each of the bearing members is formed with an opening that allows the respective transmission rollers to be attachable in a direction orthogonal to the rotation axis, and the bearing members comprise a first bearing member rotatably supporting a first transmission roller and a second bearing member rotatably supporting a second transmission roller, the second bearing member adjacent to the first bearing member, wherein the opening of the first bearing member opens in a first direction and the opening of the second bearing member opens in a second direction opposite to the first direction, and wherein at least one of each of the pairs of the bearing members is formed to be elastically bendable in a direction to which the rotational axis extends.

10. The image forming apparatus according to claim 9, wherein each of the bearing members is provided with an axis support groove that supports at least a part of a circumferential surface of the respective spindle, wherein the axis support groove is formed with the opening that allows the transmission roller to be attachable in a direction orthogonal to the rotational axis, and wherein each of the bearing members is provided with a retaining piece that is formed at a position adjacent to the axis support groove and the opening, the retaining piece retaining the respective spindle in the axis support groove.

11. The image forming apparatus according to claim 10, wherein a bottom face of the axis support groove is formed at a side to support an external force that acts in the direction orthogonal to the rotational axis when feeding the sheet by rotating the feed roller.

12. The image forming apparatus according to claim 9, wherein at least one of each of the pairs of the bearing members is fixed on the arm member at a base end thereof to be bendable at a leading end in the direction to which the rotational axis extends.

13. The image forming apparatus according to claim 10, wherein at least one of the opening and the retaining piece is formed with an inclined guide face that guides the respective spindle into the axis support groove.

14. The image forming apparatus according to claim 9, wherein, with respect to a position of the spindle of one of the transmission rollers that is disposed upstream in a direction the power is transmitted, a position of the spindle of adjacent one of the transmission rollers that is disposed downstream is offset in a direction opposite a direction of a rotation moment applied by the adjacent upstream transmission roller.

15. The image forming apparatus according to claim 9, wherein the arm member and the bearing members are monolithically formed of a synthetic resin material.

16. The image forming apparatus according to claim 9, wherein each of the transmission rollers is a gear that is formed of a synthetic resin material monolithically with the spindle.

* * * * *